US007967076B2

(12) United States Patent
Kim et al.

(10) Patent No.: US 7,967,076 B2
(45) Date of Patent: Jun. 28, 2011

(54) FLOW-ACTUATED ACTUATOR AND METHOD

(75) Inventors: Namhyo Kim, Houston, TX (US); Yang Xu, Houston, TX (US); Lale Korkmaz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/469,310

(22) Filed: May 20, 2009

(65) Prior Publication Data

US 2010/0294509 A1 Nov. 25, 2010

(51) Int. Cl.
*E21B 34/00* (2006.01)

(52) U.S. Cl. ..... 166/386; 166/373

(58) Field of Classification Search ..... 166/373, 166/381, 386, 321, 322, 324, 319, 317, 332.1, 166/332.8, 334.1; 137/68.16, 68.17
See application file for complete search history.

(56) References Cited

U.S. PATENT DOCUMENTS

| | | | | |
|---|---|---|---|---|
| 3,151,839 | A | 10/1964 | Mott | |
| 3,973,586 | A | 8/1976 | Hill et al. | |
| 4,161,219 | A | 7/1979 | Pringle | |
| 4,215,748 | A | 8/1980 | Pace et al. | |
| 4,274,490 | A | 6/1981 | Huckaby | |
| 4,362,214 | A | 12/1982 | Pringle et al. | |
| 4,373,587 | A | 2/1983 | Pringle | |
| 4,444,266 | A * | 4/1984 | Pringle | 166/324 |
| 4,601,342 | A | 7/1986 | Pringle | |
| 4,834,183 | A | 5/1989 | Vinzant et al. | |
| 4,856,557 | A | 8/1989 | Watson | |
| 5,004,007 | A | 4/1991 | Johnson et al. | |
| 5,040,606 | A | 8/1991 | Hopper | |
| 5,050,839 | A | 9/1991 | Dickson et al. | |
| 5,095,994 | A | 3/1992 | Dollison | |
| 5,179,973 | A | 1/1993 | Dickson et al. | |
| 5,310,005 | A | 5/1994 | Dollison | |
| 5,752,569 | A | 5/1998 | Bhavsar et al. | |
| 6,003,605 | A * | 12/1999 | Dickson et al. | 166/375 |
| 6,302,210 | B1 | 10/2001 | Crow et al. | |
| 6,394,187 | B1 | 5/2002 | Dickson et al. | |
| 6,668,935 | B1 | 12/2003 | McLoughlin et al. | |
| 6,732,803 | B2 * | 5/2004 | Garcia et al. | 166/373 |
| 6,877,564 | B2 | 4/2005 | Layton et al. | |
| 6,902,006 | B2 | 6/2005 | Myerley et al. | |

(Continued)

OTHER PUBLICATIONS

Pierce, P. E., et al., "Flow Closing Coefficients from Water Flow Tests for Subsurface Controlled Safety Valves (API-SSCSV's)," Fall Meeting of the Society of Petroleum Engineers of AIME, Dallas, Texas, Sep. 28, 1975-Oct. 1, 1975, Paper No. 5601-MS.

(Continued)

*Primary Examiner* — Robert E Pezzuto
(74) *Attorney, Agent, or Firm* — Cantor Colburn LLP

(57) ABSTRACT

An actuator includes, a first tubular, a second tubular longitudinally movably disposed within the first tubular and movable in response to fluid flow therethrough, the second tubular having a full bore therethrough, and a movable member movably attached to the second tubular and movable with the second tubular relative to the first tubular. The movable member is movable between a first position and a second position, the movable member is unobstructive of the full bore when in the first position and at least partially occluding of the full bore when in the second position, the movable member is movable from the first position to the second position in response to movement of the second tubular.

27 Claims, 4 Drawing Sheets

U.S. PATENT DOCUMENTS

| | | | | |
|---|---|---|---|---|
| 7,021,386 | B2 | 4/2006 | Vick, Jr. et al. | |
| 7,137,452 | B2 | 11/2006 | McVicker | |
| 7,210,498 | B2 | 5/2007 | Arigoni | |
| 7,213,653 | B2 | 5/2007 | Vick, Jr. | |
| 7,246,668 | B2 * | 7/2007 | Smith | 166/386 |
| 7,270,191 | B2 | 9/2007 | Drummond et al. | |
| 7,347,270 | B2 | 3/2008 | McMillan et al. | |
| 7,363,980 | B2 | 4/2008 | Pringle | |
| 7,409,996 | B2 | 8/2008 | Myerley et al. | |
| 2001/0007284 | A1 | 7/2001 | French et al. | |
| 2006/0070744 | A1 | 4/2006 | Smith | |
| 2006/0162939 | A1 | 7/2006 | Vick, Jr. et al. | |
| 2007/0137869 | A1 | 6/2007 | MacDougall et al. | |
| 2007/0227738 | A1 * | 10/2007 | Dennistoun et al. | 166/316 |
| 2007/0295515 | A1 | 12/2007 | Veneruso et al. | |
| 2008/0164035 | A1 | 7/2008 | Bolding et al. | |
| 2008/0196898 | A1 | 8/2008 | Jasser et al. | |
| 2008/0210438 | A1 | 9/2008 | Bolding et al. | |
| 2008/0230231 | A1 | 9/2008 | Bolding et al. | |
| 2008/0245531 | A1 | 10/2008 | Noske et al. | |

OTHER PUBLICATIONS

Pedigo, John, et al., "An Acoustically Controlled Down-Hole Safety Valve (SCSSSV)," SPE Annual Fall Technical Conference and Exhibition, New Orleans, Louisiana, Oct. 3-6, 1976, Paper No. 6026-MS.

Surbey, D.W., et al., "Study of Subcritical Flow Through Multiple-Orifice Valves," SPE Production Engineering, vol. 3, No. 1, Feb. 1988, Paper No. 14285-PA.

Bolding, J.L., et al., "Damaged Control Line Replacement Safety Valve System: Thru-Tubing," SPE/ICoTA Coiled Tubing & Well Intervention Conference and Exhibition, Mar. 31-Apr. 1, 2009, The Woodlands, Texas, Paper No. 121407-MS.

* cited by examiner

FLOW-ACTUATED ACTUATOR AND METHOD

BACKGROUND

A variety of downhole tool actuators are available to well operators that provide an array of actuation mechanisms. One common actuator system includes dropping a ball to a seat and pressuring up against the ball to actuate a device. One drawback with such systems is the necessity of removing the ball after the actuation is complete. Another drawback is the dimensional restriction necessarily formed by the ball seat that prevents full bore access unless the seat is removed. Actuators that do not detrimentally affect full bore access activity nor require removal of components subsequent to actuation are well received in the industry.

BRIEF DESCRIPTION

Disclosed herein is a downhole flow-actuated actuator. The actuator includes, a first tubular, a second tubular longitudinally movably disposed within the first tubular and movable in response to fluid flow therethrough, the second tubular having a full bore therethrough, and a movable member movably attached to the second tubular and movable with the second tubular relative to the first tubular. The movable member is movable between a first position and a second position, the movable member is unobstructive of the full bore when in the first position and at least partially occluding of the full bore when in the second position, the movable member is movable from the first position to the second position in response to movement of the second tubular.

Further disclosed herein is a method of actuating a downhole actuator. The method includes, flowing fluid through the downhole actuator having a first tubular and a second tubular, moving the second tubular with a first urging force generated by fluid flowing through a full inner bore of the second tubular, moving a movable member to at least partially occlude flow through the full inner bore of the second tubular, and actuatingly moving the second tubular with a second urging force generated by fluid flowing against the at least partially occluded second tubular.

Further disclosed herein is a downhole flow-actuated actuator. The actuator includes, a first tubular having a flow passageway, a second tubular longitudinally aligned with the first tubular, the second tubular is longitudinally movable relative to the first tubular, a movable member in operable communication with the second tubular and movable between a first position and a second position, the movable member substantially allowing full bore access to the second tubular when in the first position and at least partially occluding flow through the second tubular when in the second position. The actuator further includes and a cam disposed at the first tubular, the cam is engagable with the movable member when the movable member is in the first position and disengagable with the movable member when the movable member is in the second position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
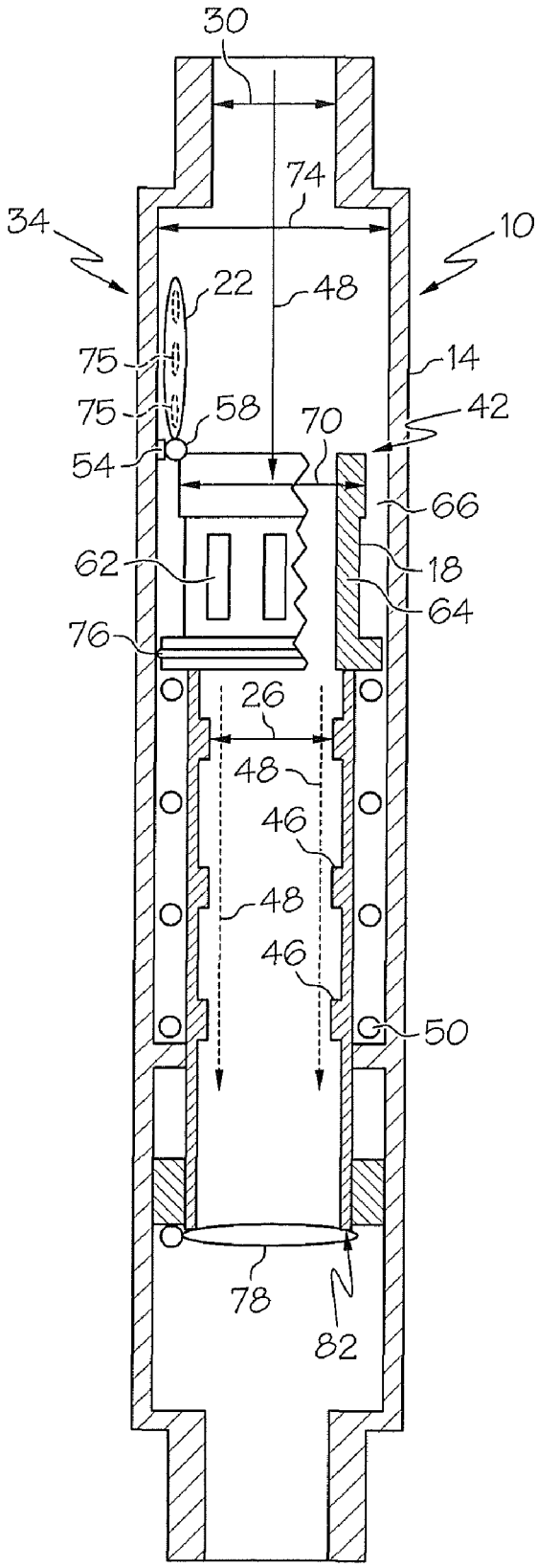
FIG. 1 depicts a partial cross sectional view of a downhole flow-actuated actuator disclosed herein in a non-actuated configuration.
Figure 2:
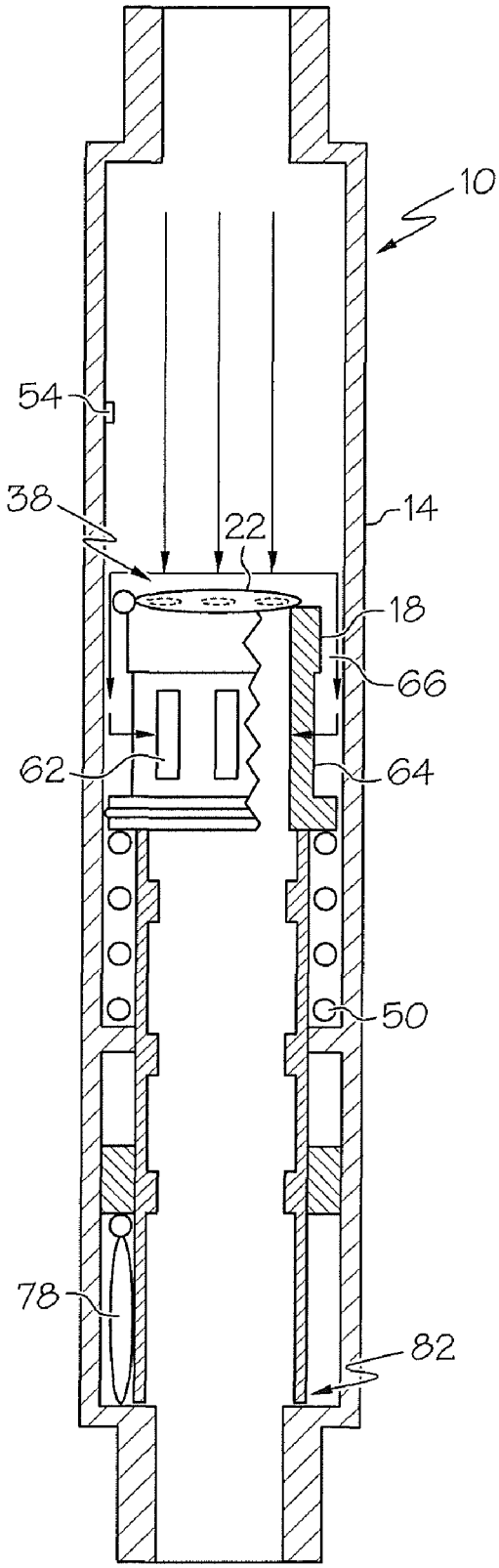
FIG. 2 depicts a partial cross sectional view the downhole flow-actuated actuator of FIG. 1 in an actuated configuration.
Figure 3A:
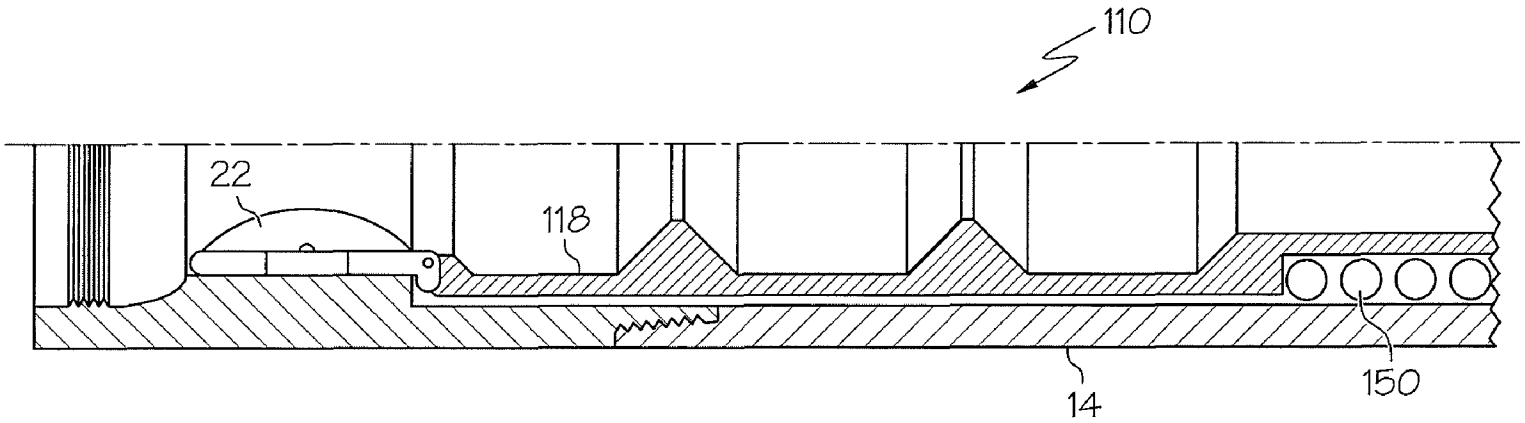
FIGS. 3A and 3B depict a partial cross sectional view of an alternate downhole flow-actuated actuator disclosed herein in a non-actuated configuration.
Figure 4B:
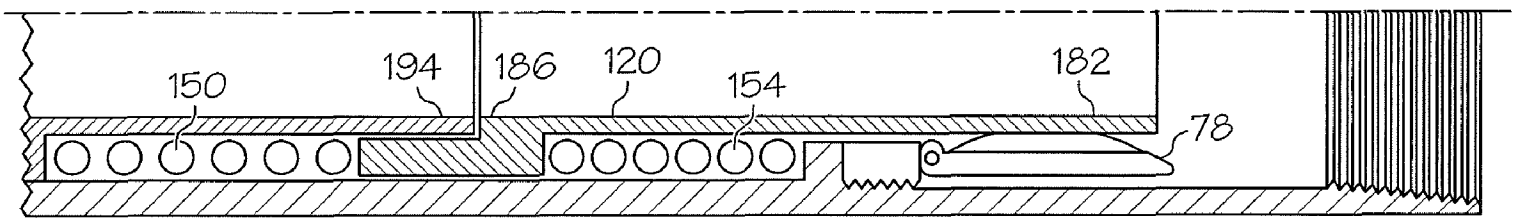
FIGS. 4A and 4B depict a partial cross sectional view of the downhole flow-actuated actuator of FIGS. 3A and 3B in an actuated configuration.
Figure 4A:
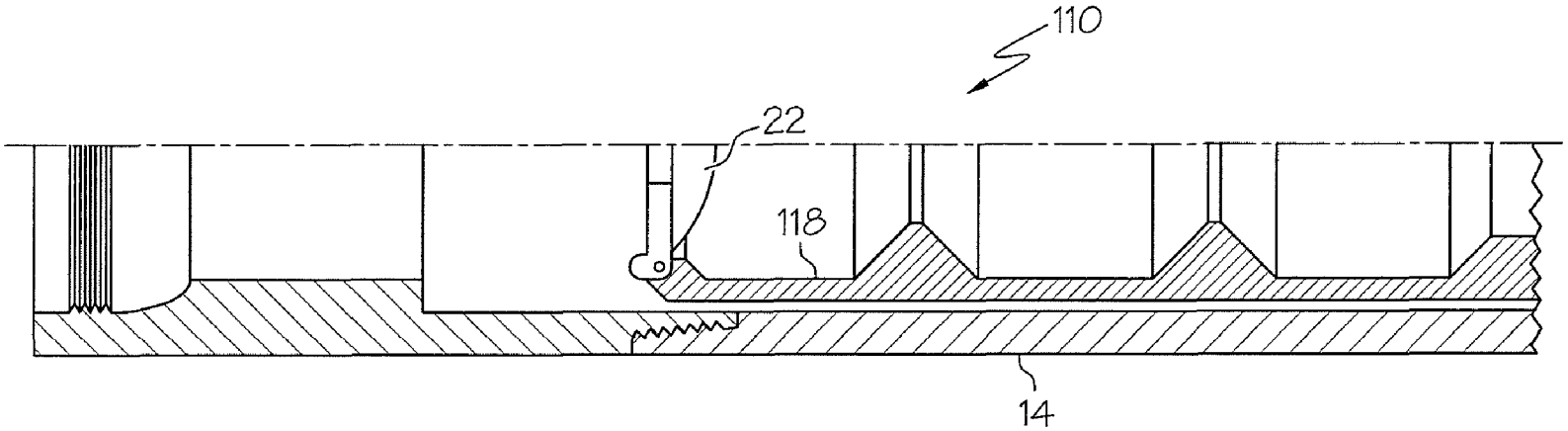
Figure 3B:
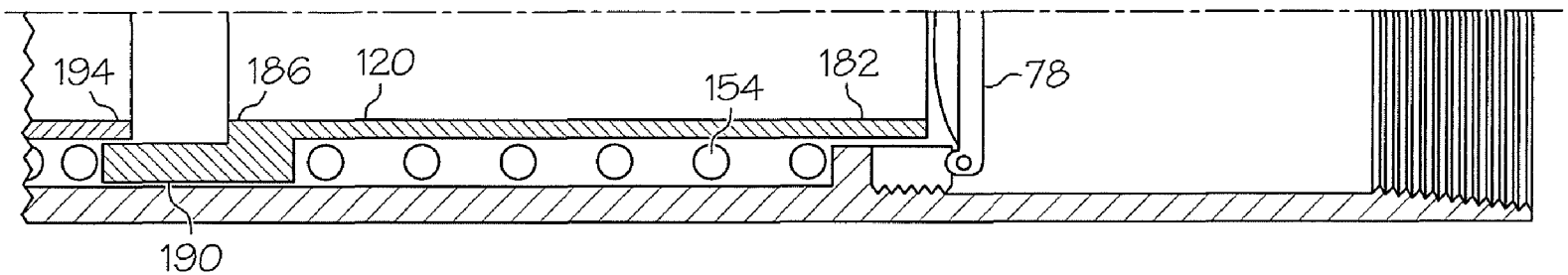

Referring to FIGS. 1 and 2, an embodiment of a downhole flow-actuated actuator disclosed herein is illustrated generally at 10. The actuator 10 includes, first tubular 14, that serves as a housing for the actuator 10, a second tubular 18, that is longitudinally movable with respect to the first tubular 14, and a movable member 22, depicted in this embodiment as a flapper. The second tubular 14, illustrated herein as a flow tube, has a full bore 26 therethrough that is no smaller than a smallest inner dimension 30 of the first tubular 14 or elsewhere along a drillstring (not shown) connectable to the first tubular 14. As such, neither of the tubulars 14, 18, in and of themselves, presents a restriction to the full bore 26, permitting unobstructed downhole access through the actuator 10. The movable member 22 is movable between a first position 34 (as shown in FIG. 1) and a second position 38 (as shown in FIG. 2), relative to the second tubular 18. When in the second position 38, the movable member 22 is engaged with a first end 42 of the second tubular 18, thereby at least partially occluding the full bore 26 therethrough. In contrast, when in the first position 34, the movable member 22 is oriented well away from the first end 42, and as such provides substantially no obstruction to the full bore 26.

The second tubular 18 includes at least one flow resistor 46, with three being shown herein as annular changes in an inner radial dimension along the full bore 26. The flow resistors 46, although no smaller in an inner dimension thereof than the full bore 26, present a discontinuity in the full bore 26 that creates a pressure drop thereacross in response to fluid flow, along arrows 48, for example, therethrough. The pressure drop results in an urging force on the second tubular 18, proportional to the fluid flow therethrough, in a direction of the fluid flow (the direction of arrows 48 for injected fluid). A biasing member 50, that biases the second tubular 18 in a direction opposite to that of the urging of injected fluid flow, is selected to maintain the second tubular 18 in the first position 34 until a selected flow is achieved. At flows above the selected flow the second tubular 18 moves as the biasing member 50 yields to the urging force generated by the fluid flow.

A cam 54, attached to the first tubular 14, interacts with the movable member 22, when the second tubular 18 is in a position defined by full extension of the biasing member 50, to maintain the movable member 22 in the first position 34. As such, the movable member 22 is prevented from moving toward the second position 38 until the second tubular 18 begins moving thereby allowing the cam 54 to disengage from the movable member 22 allowing the movable member 22 to move toward the second position 38. In this embodiment, the movable member 22 is hingedly attached to the first end 42 of the second tubular 18 at pivot 58, although other movable attachments are contemplated. The movable member 22 can be configured such that fluid flow thereby generates a closing force there on.

As the movable member 22 moves toward the second position 38, it presents a greater resistance to fluid flow therearound, which in turn increases urging forces on the second tubular 18 from the fluid flow. Since, in this embodiment, the movable member 22 fully occludes the full bore 26 when in the second position 38, thereby resulting in the largest urging forces on the second tubular 18.

A plurality of openings 62, illustrated in this embodiment as radially oriented slots, in a wall 64 of the second tubular 18 permits fluid to flow therethrough and into the full bore 26. The openings 62, in this embodiment, are configured symmetrically (radially) about a longitudinal axis of the actuator 10. The fluid first flows through an annular space 66 between an outer dimension 70 of the second tubular 18 and an inner dimension 74 of the first tubular 14 before reaching the openings 62. An optional seal 76 between the first tubular 14 and the second tubular 18 assures that substantially all of the flow travels through the openings 62. The foregoing construction provides a well operator accurate control over the flow restriction created by the actuator 10 when the movable member 22 is in the second position 38 while still permitting fluid flow through the actuator 10. Accurate control of the flow restriction is desirable to accurately control forces on the second tubular 18 due to the fluid flow. In an application wherein the second tubular 18 is a flow tube, as in the current embodiment, actuation of the flow tube 18 is used to open a second flapper 78 that is sealable to a second end 82 of the flow tube 18. In other embodiments, bypass flow passages can be formed on the movable member 22, illustrated herein in dashed lines as ports 75, or in an engagement area between the movable member 22, (such as by teeth not shown) and the second tubular 18.

A biasing force of the biasing member 50 can be set to return the second tubular 18 to the original, non-actuated configuration when fluid flow as ceased. This return bias can also cause the movable member 22 to move from the second position 38 to the first position 34 in response to engagement with the cam 54. A second biasing member (not shown) can bias the movable member 22 toward the second position 38 to aid in closing the movable member 22 the force of which must be overcome when returning the movable member 22 to the first position 34. The second flapper 78 can also be biased by a biasing member (not shown) to aid in returning the second flapper 78 to the closed position when flow ceases and the second tubular 18 is returned to the non-actuated configuration.

Referring to FIGS. 3A-4B, an alternate embodiment of a downhole flow-actuated actuator is illustrated generally at 110. The actuator 110 is similar to the actuator 10 and as such like elements are numbered alike and are not described again in detail. A significant difference between the actuators 110 and 10 is that the actuator 110 has two biasing members 150 and 154, and a third tubular 120. The third tubular 120 is longitudinally movable relative to both the first tubular 14 and the second tubular 118. The first biasing member 150 biases the third tubular 120 relative to the first tubular 14 in a direction opposing the flow of injected fluid. The second biasing member 154 is positioned between the second tubular 118 and the third tubular 120 and biases them away from one another. Biasing forces of the biasing members 150, 154 can be set relative to one another such that one or the other deforms under loading before the other. Deformation of the second biasing member 154 allows the second flapper 78, initially sealingly engaged with a second end 182 of the third tubular 120, to open as the second end 182 moves therethrough. Deformation of the first biasing member 150 allows the second tubular 118 to move closer to the third tubular 120 until, for example, contact between a shoulder 186 near a first end 190 of the third tubular 120 contacts a second end 194 of the second tubular 118, after which the tubulars 118, 120 move together.

An advantage of having the two biasing members 150 and 154 is to separate control of the urging forces needed to move the second tubular 118 from that needed to move the third tubular 120. For example, the biasing force of the first biasing member 150 can be small in comparison to the biasing force of the second biasing member 154. As such, the second tubular 118 can move in response to relatively little urging force acting thereon, thereby deforming the first biasing member 150. And the third tubular 120 can move in response to a relatively high urging force acting thereon, thereby deforming the second biasing member 154. The higher urging forces needed to deform the second biasing member 154 can easily be achieved by the significantly reduced flow area available to bypass the movable member 22 (and the second tubular 118) when in the second position 38 (closed configuration). Indeed, the bypass flow area can be set to any desirable level including no bypass flow area at all. Such a configuration allows the full pressure of the injected fluid to act upon the actuator 110 during actuation.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole flow-actuated actuator, comprising:

a first tubular;

a second tubular longitudinally movably disposed within the first tubular being movable in response to fluid flow therethrough, the second tubular having a full bore therethrough; and a movable member movably attached to the second tubular and movable with the second tubular relative to the first tubular, the movable member being movable between a first position and a second position, the movable member being unobstructive of the full bore when in the first position and at least partially occluding of the full bore when in the second position, the movable member being movable from the first position to the second position in response to movement of the second tubular.

2. The downhole flow-actuated actuator of claim 1, wherein the movable member is hingedly attached to the second tubular.

3. The downhole flow-actuated actuator of claim 1, wherein fluid flow urges the movable member toward at least partial occluding engagement with the full bore.

4. The downhole flow-actuated actuator of claim 1, wherein a cam maintains the movable member in the first position until movement of the second tubular.

5. The downhole flow-actuated actuator of claim 4, wherein the cam is disposed at the first tubular.

6. The downhole flow-actuated actuator of claim 1, wherein the movable member is a flapper.

7. The downhole flow-actuated actuator of claim 1, wherein at least one opening disposed at least one of the second tubular and the movable member allow passage of fluid to the full bore when the movable member is in the second position.

8. The downhole flow-actuated actuator of claim 7, wherein the at least one opening is oriented radially.

9. The downhole flow-actuated actuator of claim 7, wherein the at least one opening is a plurality of openings and the plurality of openings are oriented substantially symmetrical radially about a longitudinal axis of the second tubular.

10. The downhole flow-actuated actuator of claim 1, wherein an outer radial surface of the second tubular is slidingly sealably engaged with an inner radial surface of the first tubular.

11. The downhole flow-actuated actuator of claim 1, further comprising a biasing member configured to longitudinally biased relative to the first tubular relative to the second tubular.

12. The downhole flow-actuated actuator of claim 11, wherein the biasing member urges the second tubular to move the movable member toward the first position.

13. The downhole flow-actuated actuator of claim 1, further comprising a third tubular longitudinally movable in relation to the first tubular and the second tubular.

14. The downhole flow-actuated actuator of claim 13, wherein the third tubular is longitudinally biased in opposing directions between the first tubular and the second tubular.

15. The downhole flow-actuated actuator of claim 14, wherein a biasing force between the third tubular and the first tubular is larger than a biasing force between the third tubular and the second tubular.

16. The downhole flow-actuated actuator of claim 13, wherein one of the second tubular and the third tubular is a flow tube.

17. The downhole flow-actuated actuator of claim 13, further comprising a flapper sealingly engagable with a downhole end of one of the second tubular and the third tubular that is.

18. A method of actuating a downhole actuator, comprising:

flowing fluid through the downhole actuator having a first tubular and a second tubular;

moving the second tubular with a first urging force generated by fluid flowing through a full inner bore of the second tubular;

moving a movable member from a first position to a second position relative to the second tubular to at least partially occlude flow through the full inner bore of the second tubular;

maintaining the movable member in the second position relative to the second tubular; and actuatingly moving both the second tubular and the movable member maintained at the second position relative to the first tubular with a second urging force generated by fluid flowing against the at least partially occluded second tubular.

19. The method of actuating a downhole actuator of claim 18, wherein the second urging force is greater than the first urging force.

20. The method of actuating a downhole actuator of claim 18, wherein at least one of the first urging force and the second urging force are proportional to fluid flow.

21. The method of actuating a downhole actuator of claim 18, wherein the moving the movable member includes disengaging the movable member from a hold open cam.

22. The method of actuating a downhole actuator of claim 21, wherein the disengaging the movable member from the hold open cam is in response to the moving of the second tubular.

23. The method of actuating a downhole actuator of claim 18, further comprising biasing the movable member toward a position to at least partially occlude the first tubular.

24. The method of actuating a downhole actuator of claim 18, further comprising biasing the second tubular in a direction opposite to a direction of the flowing fluid.

25. The method of actuating a downhole actuator of claim 18, wherein the moving the movable member includes pivoting the movable member with respect to the second tubular.

26. The method of actuating a downhole actuator of claim 18, further comprising flowing fluid in an annular space between the first tubular and the second tubular.

27. A downhole flow-actuated actuator, comprising:

a first tubular having a flow passageway;

a second tubular longitudinally aligned with the first tubular, the second tubular being longitudinally movable relative to the first tubular;

a movable member in operable communication with the second tubular being movable between a first position and a second position, the movable member substantially allowing full bore access to the second tubular when in the first position and at least partially occluding flow through the second tubular when in the second position; and a cam disposed at the first tubular, the cam being engagable with the movable member in response to the movable member being in the first position and disengagable with the movable member in response to the movable member being in the second position.

* * * * *